US006226986B1

(12) United States Patent
Driver et al.

(10) Patent No.: US 6,226,986 B1
(45) Date of Patent: May 8, 2001

(54) ROTARY POSITIVE DISPLACEMENT FLUID MACHINE

(75) Inventors: Ronald William Driver, Lancashire; Ann Margaret Driver, Lancshire, both of (GB)

(73) Assignee: Driver Technology Ltd., Leicestershire (GB)

( * ) Notice: Subject to any disclaimer, the term of this patent is extended or adjusted under 35 U.S.C. 154(b) by 0 days.

(21) Appl. No.: 08/973,523

(22) PCT Filed: Jun. 5, 1996

(86) PCT No.: PCT/GB96/01333

§ 371 Date: Dec. 5, 1997

§ 102(e) Date: Dec. 5, 1997

(87) PCT Pub. No.: WO96/39571

PCT Pub. Date: Dec. 12, 1996

(30) Foreign Application Priority Data

Jun. 6, 1995 (GB) ..... 9511409
Nov. 8, 1995 (GB) ..... 9522831

(51) Int. Cl.[7] ..... F16D 31/02
(52) U.S. Cl. ..... 60/397; 60/407

(58) Field of Search ..... 60/396, 397, 370, 60/407

(56) References Cited

U.S. PATENT DOCUMENTS 3,299,629 * 1/1967 Bouchard ..... 60/397 X
4,439,983 * 4/1984 Gertz ..... 60/397 X

FOREIGN PATENT DOCUMENTS

0248613 * 12/1987 (EP) .
2010401 * 6/1979 (GB) .
2086987 * 5/1982 (GB) ..... 60/397
6-81668 * 3/1994 (JP) ..... 60/397
92/09800 * 6/1992 (WO) ..... 60/397

* cited by examiner

*Primary Examiner*—Hoang Nguyen

(57) ABSTRACT

A rotary machine has a rotor eccentrically mounted in a casing and having a plurality of vanes connected to oscillating arms via cranks, the cranks having elements pivotally embracing a radial outer end of the arms. The arms can be radial. The rotor has outer axial parts connected to an intermediate part by grooves and rings resisting radial expansion. The rotary machine can be used in a fuel-injected engine for example to derive energy from the difference in air pressure between ambient and the inlet manifold.

19 Claims, 17 Drawing Sheets

X
C
1
2
3
4
5
6
7
8
9
65a
65b
65d

ROTARY POSITIVE DISPLACEMENT FLUID MACHINE

This invention relates to engines and rotary machines.

Examples of rotary machines are in GB 2010401 and 2039328 and 2194322 and U.S. Pat. No. 4362014 and U.S. Pat. No. 4831827 and EP-A-248613.

According to one aspect of the invention, an internal combustion engine has a rotary positive-displacement fluid device connected to be driven by the pressure difference between ambient air and the inlet manifold of the engine, the device being operatively connected to an energy-using device.

The energy-using device may be a crank-shaft of the engine or an alternator for charging a battery.

The rotary device may be arranged to deliver compressed air to a fuel-injection device for the engine.

There may be a source of compressed air independent of the engine for driving the rotary device.

From another aspect the invention provides an internal combustion engine having a rotary positive-displacement fluid device operatively connected to the engine crankshaft and arranged to be driven by compressed air from a source independent of the engine.

According to another aspect of the invention a rotary positive-displacement fluid machine has a rotor eccentrically mounted in a casing, the rotor having a plurality of vanes, each vane being connected to an oscillating arm via a crank and having a pivot axle, the crank having elements pivotally embracing a radial outer end of the oscillating arm.

The oscillating arms may be radial.

From another aspect of the invention, a rotary positive-displacement fluid machine has a rotor eccentrically mounted in a casing, the rotor having a plurality of vanes, each vane being connected to an oscillating arm via a crank and having a pivot axle, the oscillating arms being radial to the rotor axis.

The oscillating arms may be in adjacent pairs with confronting faces and have groove means for access of lubricating oil.

The cranks may have the same shape.

The pivot axles may have the same length or differing lengths.

The oscillating arms may be rotatable on a sleeve rotatable on a support pillar. The rotor may have axially outer parts and an axially intermediate part, the intermediate part being split to permit circumferential expansion and the outer parts being connected to the intermediate part by means which resist radial movement.

From another aspect a rotary positive-displacement fluid machine has a rotor eccentrically mounted in a casing with vanes defining compartments with the casing, in which the rotor has axially outer parts and an axially intermediate part, the intermediate part being split to permit circumferential expansion and the outer parts being connected to the intermediate part by means which resist radial movement.

The means which resist radial movement may comprise interengaging formations on the outer parts and the intermediate part.

The interengaging formations may comprise grooves on the outer parts and annular rings on the intermediate part or annular rings on the outer parts and grooves on the intermediate part.

The intermediate part may be in a machine as above.

The machine may be adapted to deliver refrigerant to a heat exchanger.

The invention may be performed in various ways and some specific embodiments will now be described by way of example with reference to the accompanying diagrammatic drawings, in which.

Rotary machines are known of the kind comprising:

(a) a casing;

(b) a rotor rotatable eccentrically in the casing and having means to define with the casing, peripheral compartments which are separate from each other;

(c) an inlet for the inflow of a fluid to the compartments sequentially as the rotor rotates;

(d) an outlet, displaced in the direction of rotation of the rotor from the inlet, for the outflow of said fluid, and (e) a shaft whereby power can be supplied to or taken from said rotor.

Such machines can be adapted to perform an engine or expansion function by allowing a hot inlet gas to expand in the compartments as the compartments increase in volume and/or a compressor function by supplying an inlet gas to be compressed in the compartments as the compartments decrease in volume. The gas may be in the form of a vapour.

There are crank arms movable with their ends in a common path axially displaced from the region swept by the rotor and oscillating arms rotatable on and oscillatable about a pillar which is secured to or is a part of the casing, the oscillating arms being secured to the crank arms and the crank arms being secured to respective vanes so that the oscillating arms pivot the crank arms and hence the vanes to positions in which the tips of the vanes remain salient of that part of the rotor to which they are attached. The vanes and rotor define the compartments with the casing. The vanes oscillate in and out providing respective expansion and compression regions of van movement during a rotation. If the machine is used only for expansion or only for compression, the respective compression part or expansion part of the casing can be omitted. One example is shown in FIGS. 1 to 3.

Figure 1:
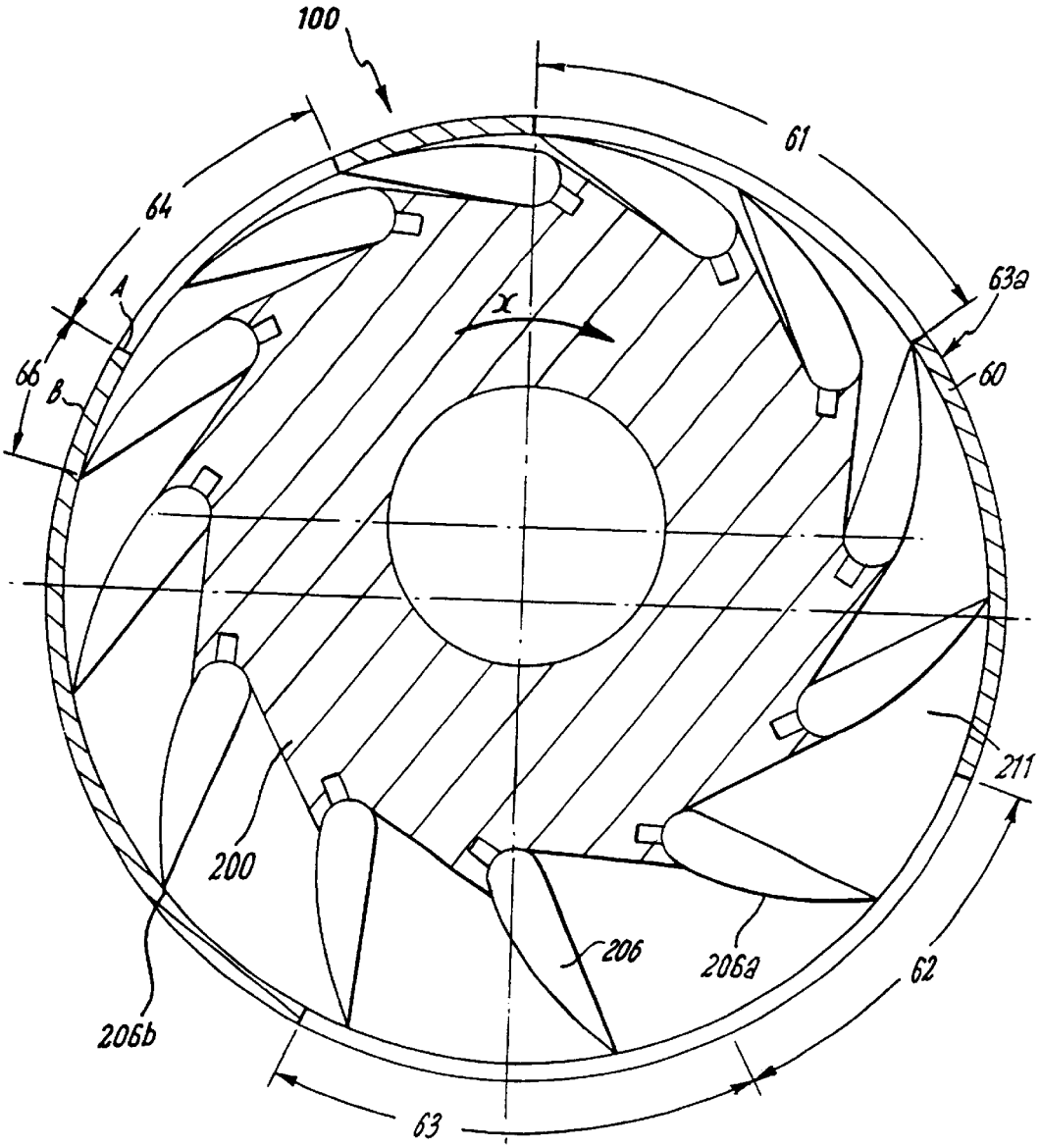
FIG. 1 is a representation of a rotor of a rotary machine.
Figure 2:
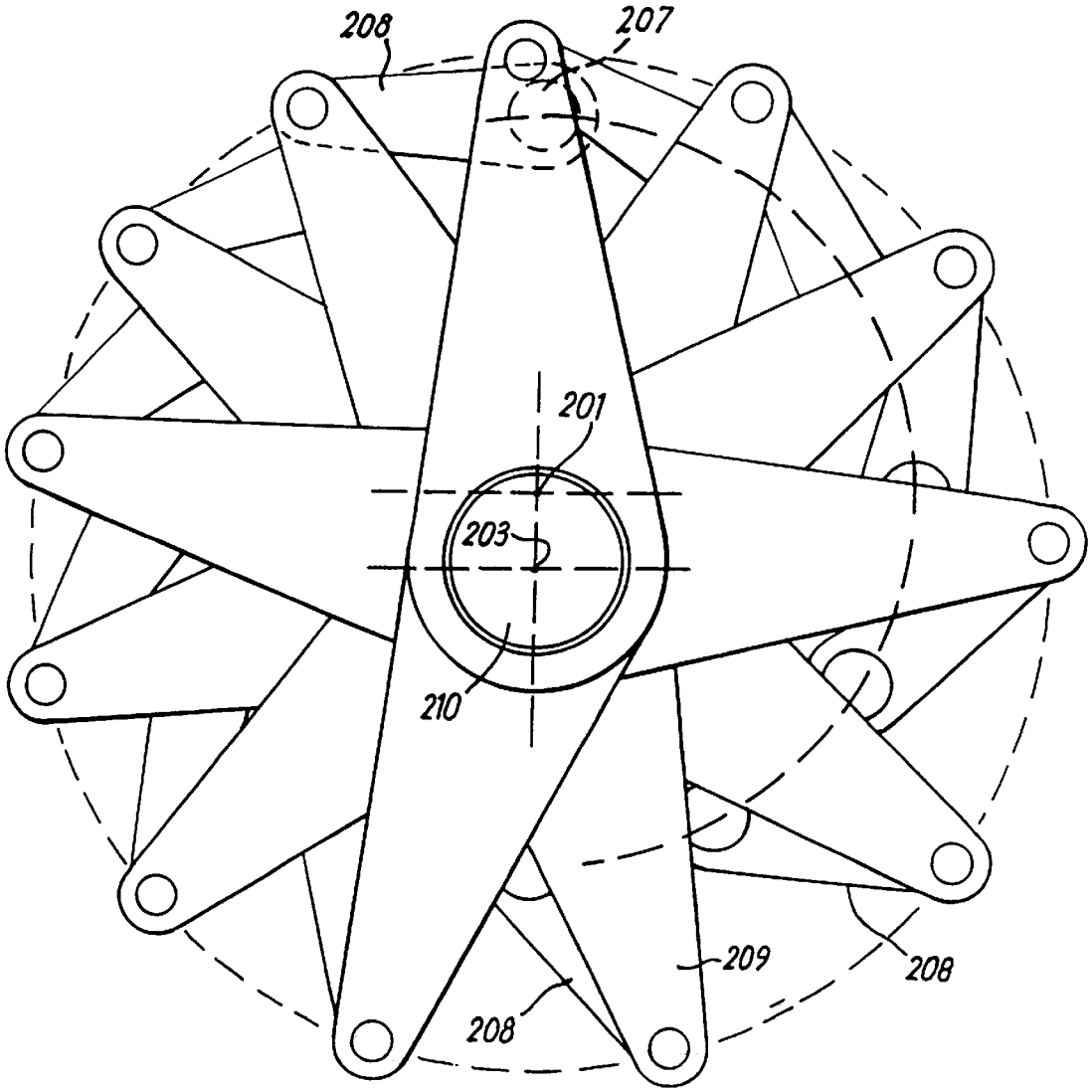
FIG. 2 is a mechanical coupling for driving vanes.
Figure 3:
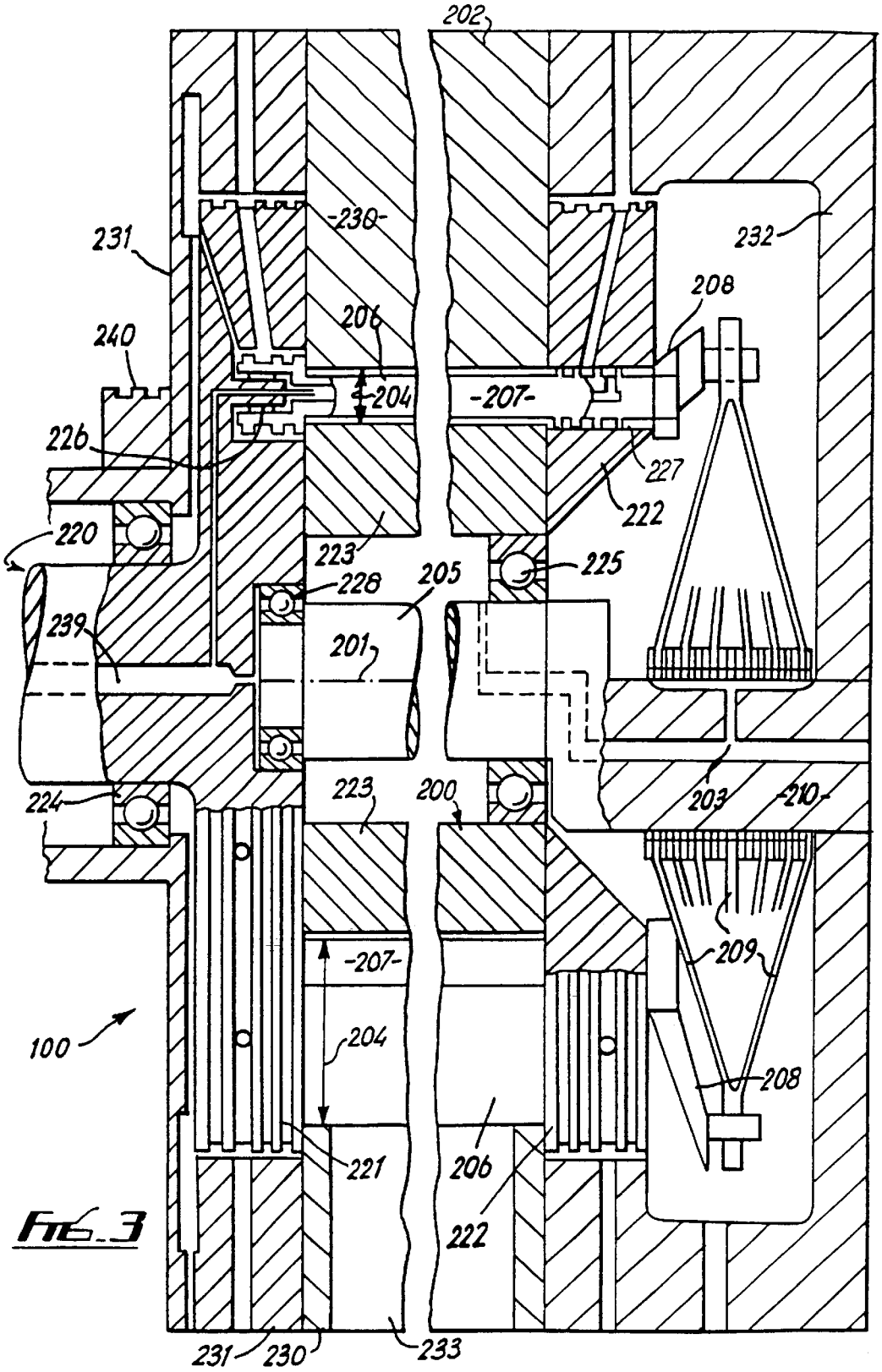
FIG. 3 is a sectional side view of part of a device using the rotor of FIG. 1.

Referring to FIGS. 1 to 3, in FIG. 3 there is shown a rotary engine 100 having an engine rotor 200 with an axis 201 and a fixed truly cylindrical casing 202 with axis 203. The rotor 200 is seen to be eccentric in the casing 202 and defines with the casing an eccentric annulus 204. The rotor 200 is rotatable on a static axle 205 and is equipped with twelve angularly spaced vanes 206 carried on pivots, indicated by axes 207, and running in the casing with a very small clearance between their tips 206*b* and the inner surfaces of the casing. The vanes 206 are each respectively mechanically coupled to cranks 208 (now see FIG. 2) and the cranks 208 are oscillated by respective connecting arms 209 mounted on a casing pillar 210, and rotatable about axis 203. The vanes 206 define peripheral compartments 211 FIG. 1 in the eccentric annulus 204 which cyclically change in volume as the rotor 200 rotates. The rotor 200 is arranged for rotation in the direction of arrow x, FIG. 1. The outer surfaces 206*a* of the vanes 206 are curved so that when the compartments 211 have smallest volume this surface substantially conforms to the inner surface of the casing and has a running clearance therewith.

Components 200 to 210 are also indicated in FIG. 3 which will now be described.

The main static parts of the engine comprise the casing 202; casing pillar 210 with axis 203; and static axle 205 with axis 201.

The main rotating parts of the engine comprise the rotor 200 which has a saw-tooth periphery and is rotatable about axis 201 of axle 205; vanes 206, rotatable about axes 207 at the roots of the saw teeth; cranks 208; and connecting arms 209. As shown in FIG. 1 the vanes 206 substantially fully radially occupy the eccentric annulus 204 (indicated by "dimension" lines 204).

Other parts of the rotor are: an input or output shaft 220 integral with a sealing, bearing and lubricating front plate 221 and rear plate 222. Between the plates 221, 222 there is the main body 223 (200) of the rotor. The rotor is carried on bearings 224, 225, 228 and the vanes 206 are supported on bearings 226, 227, in the plates 221, 222.

Other parts of the-casing are: the main block 230, the front cover plate 231 and rear cover plate 232. The block defines a radial exhaust port 233. The form and location of Inlet ports will be determined by the function the machine has to perform. Oil passages 239 are indicated.

In the case of a machine with an engine function the expansion of the supplied gas typically takes place in the peripheral compartments 211 as they increase in volume and once they are beyond the supply cut-off point. This expansion applies a driving torque to the shaft 220. As the compartments 211 change in volume, the expanded gas is exposed to an exhaust port 233 which may typically angularly extend over about 5/12 of the circumference.

Figure 5:
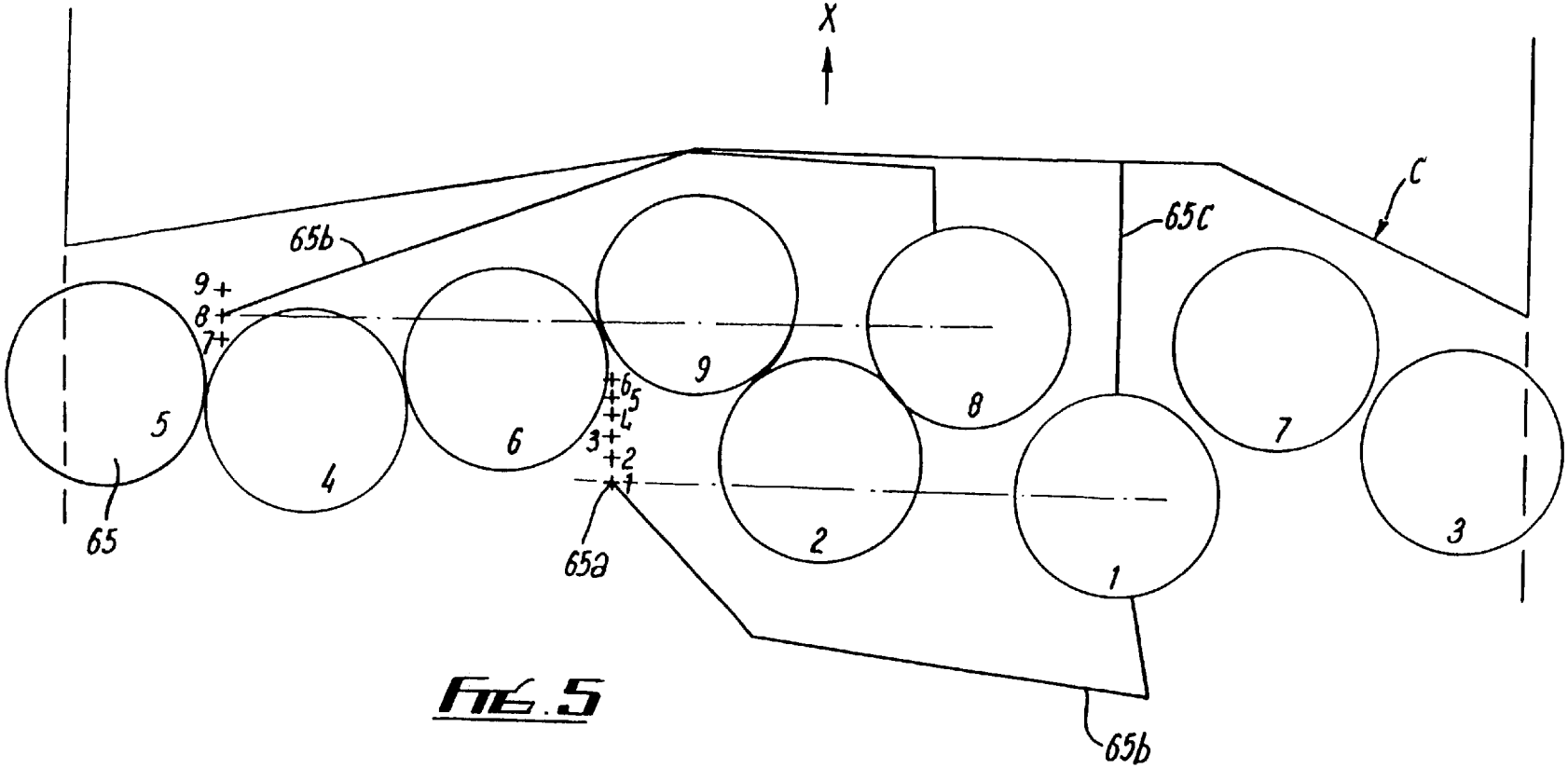
FIG. 5 shows porting for the rotor.

FIG. 1 illustrates a machine having casing 60 with expansion inlet 61, expansion exhaust port region 62, compressor inlet region 63, and compressor outlet region 64. At maximum design power and fuel consumption the vane tip 206*b* will have reached point A at the beginning of the compressor outlet region at the point of maximum compression. If fuel supply is now reduced or there is a change in working efficiency, the vane will reach the angular point of appropriate compression before point A, e.g. point B, and to avoid over-pressure being obtained as a result of rotation from B to A, valves are provided, responsive to pressure in the adjacent compartment. The valves control ports in region 66 of the casing extending upstream of B. There are typically nine valves 65 giving a nine-step adjustment and they are located as shown in FIG. 5 indicating the upstream edge C of the exhaust port.

Each valve is associated with a respective sensor 65*a* for the compartment pressure at the circumferential position of the valve and connected to the pressure tapping described later. The connection is indicated schematically at 65*b* for valves 1, 8 but omitted from the other valves for clarity. The valves overlap so that the angular extent of any over-pressurising is reduced or eliminated. Over-pressurising should preferably be of angular extent of no more than a half valve diameter.

The sensors 65*a* are located in the circumferential part of the casing and may comprise a hollow tube communicating at an inner end with an aperture in the casing and at an outer end with connection 65*b*. Region 66 is immediately upstream of the upstream edge of the outlet 64 from the compression region.

Figure 6:
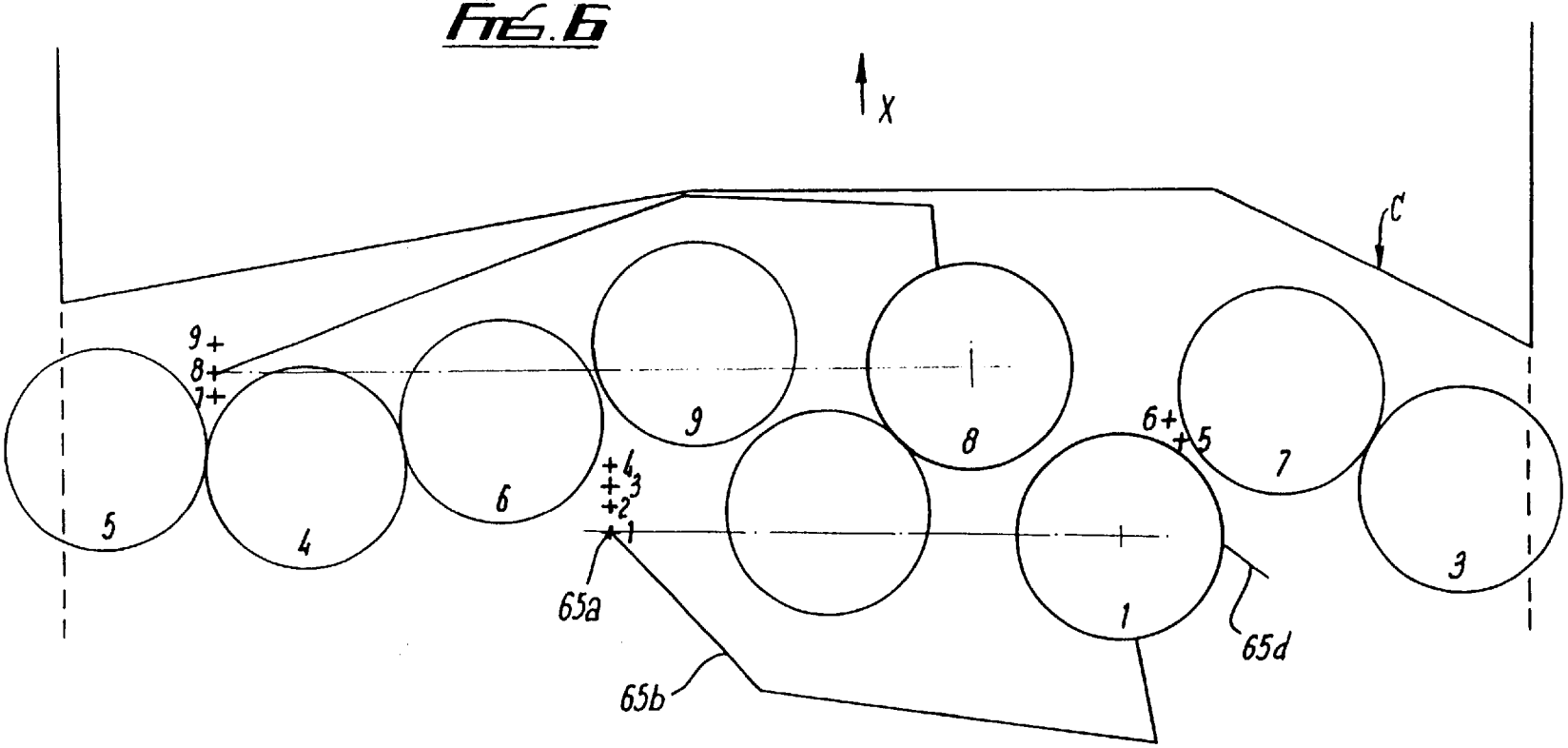
FIG. 6 shows similar porting.
Figure 7:
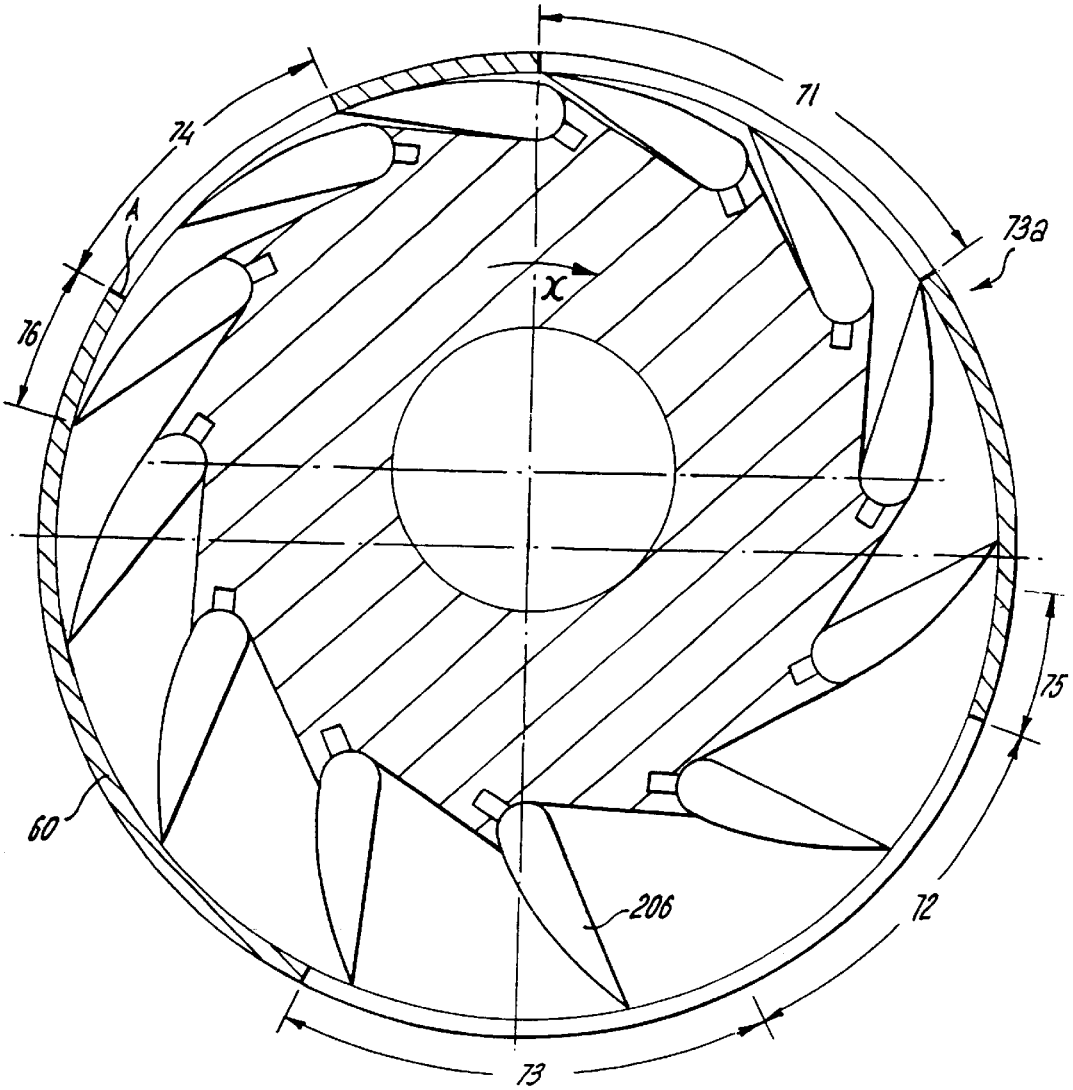
FIG. 7 shows another rotor.

Similarly, in the case of a compression machine, there is an expansion inlet region 71 FIG. 7, expansion exhaust port region 72, compressor inlet region 73, compressor outlet region 74. Valves 65 are located in region 75, to avoid suction in the expansion stage, and in region 76, to avoid over-pressure in the compression stage, with typical locations of the valve ports in region 76 shown in FIG. 6. There may typically be nine valves 65 in the region 75.

It is preferable to have valves 65 also immediately downstream of the inlet regions 61, 71 in casing regions 63*a*, 73*a*. This enables the acceleration of the rotor to be increased by increasing the drive torque as a result of admitting more gas into the inlet region via the valves.

Figure 4:
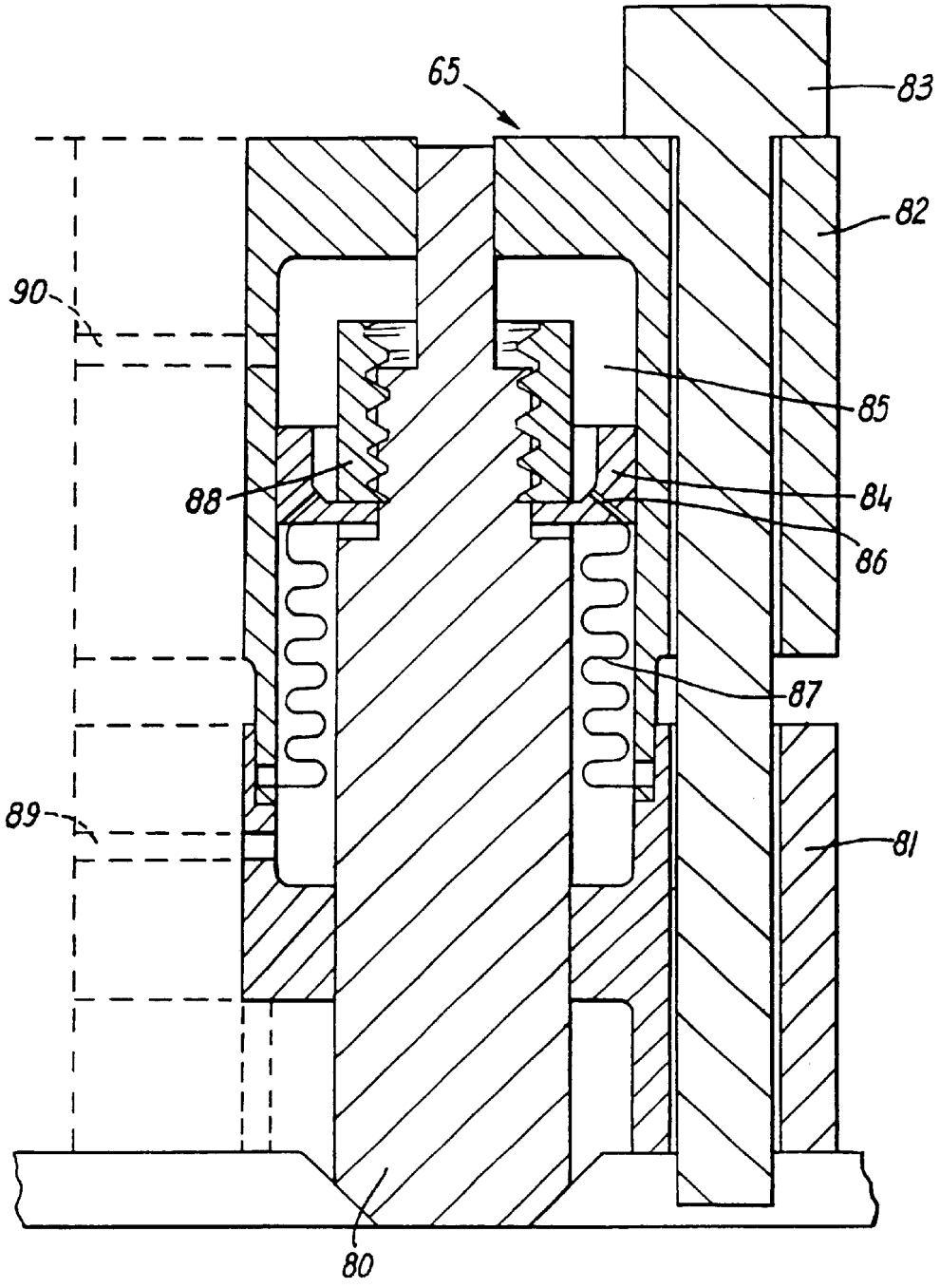
FIG. 4 shows an inlet valve.

A suitable valve 65 is shown in FIG. 4. The valve has a stem 80 for closing the respective port, and inner and outer parts 81, 82 secured together by bolt 83. A piston 84 is slidable in chamber 85 in part 82 and has a through vent 86 and is connected to bellows seal 87, being held in place on stem 80 by nut 88. Pressure tappings 89, 90 communicate with opposite sides of the piston.

The compressor sections and expander sections automatically compensate for changes brought about by the fuel control system or a change in their working efficiency in the following way:

The low pressure compressor anti-over-pressurisation valves are spring-loaded closed by their bellows, the innermost pressure tapping 89 is used to sense the pressure inside the machine annulus (i.e. the adjacent compartment) and the outer pressure tapping 90 is connected on line 65*c* to the high pressure expansion exhaust outlet.

The high pressure compressor anti-overpressurisation valves are spring-loaded closed by their bellows, the innermost pressure tapping 89 is used to sense the pressure inside the machine annulus. The outer-most tapping 90 is connected to pressure at compressor outlet 74.

The high pressure expansion exhaust anti-suction valves are spring-loaded open by their bellows; the outermost pressure tapping 90 is used to sense the pressure inside the machine annulus; the inner-most pressure tapping 89 is connected to the high pressure expansion exhaust outlet via line 65*c*, FIG. 5.

If desired there may be similar anti-suction valves immediately upstream of the low pressure exhaust opening.

The number of vanes and associated parts in the rotary machines may vary and would typically be six or more.

Preferably thrust bearings are provided to resist axial movement of vanes and maintain a running clearance between the side of the vanes and the machine side discs.

Such a machine is generally as described in U.S. Pat. No. 4,831,827.

The present arrangements provide improvements or modifications of the above.

Figure 8:
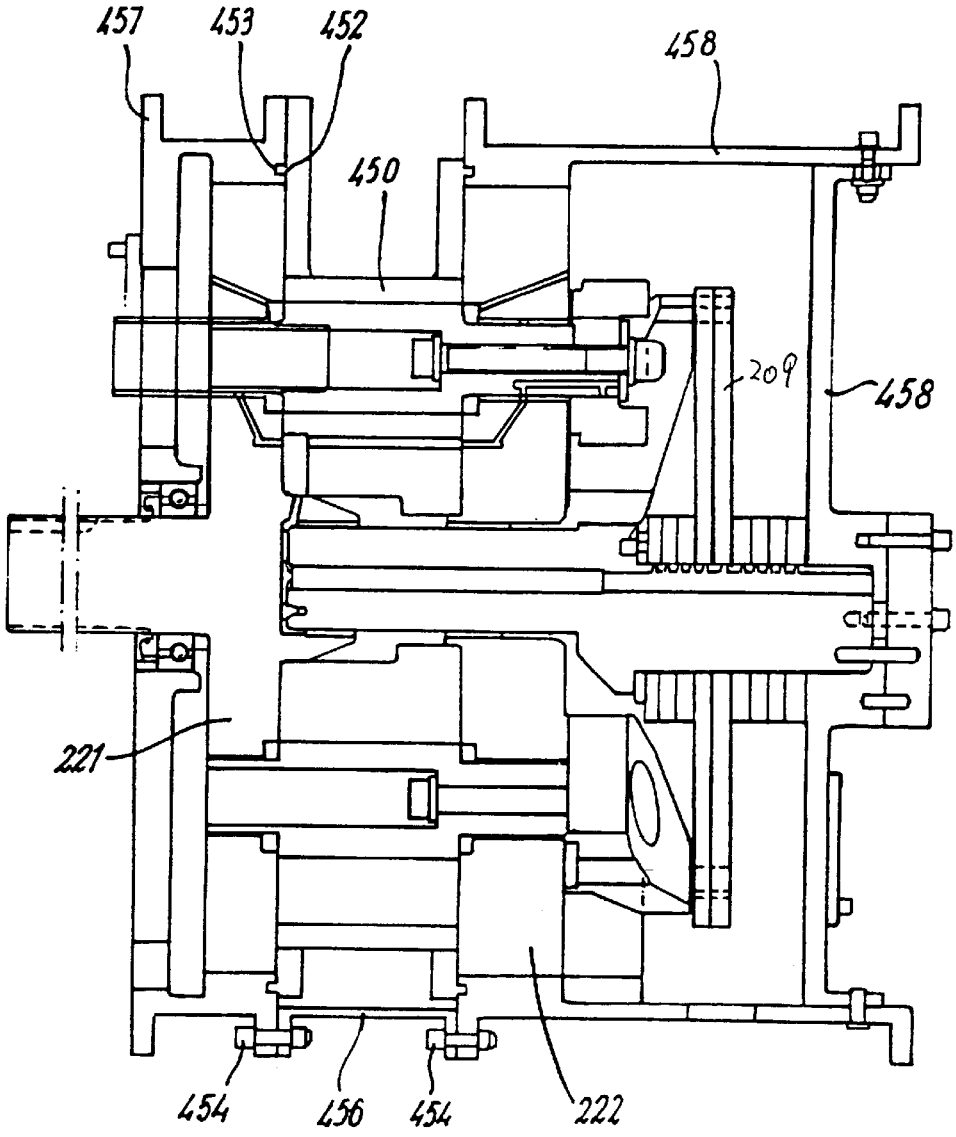
FIG. 8 is a longitudinal section through a rotor assembly
Figure 9:
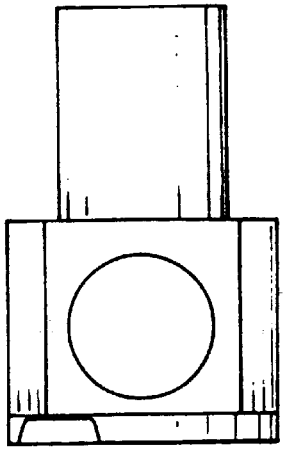
FIGS. 9 to 11 are views of a crank arm.
Figure 10:
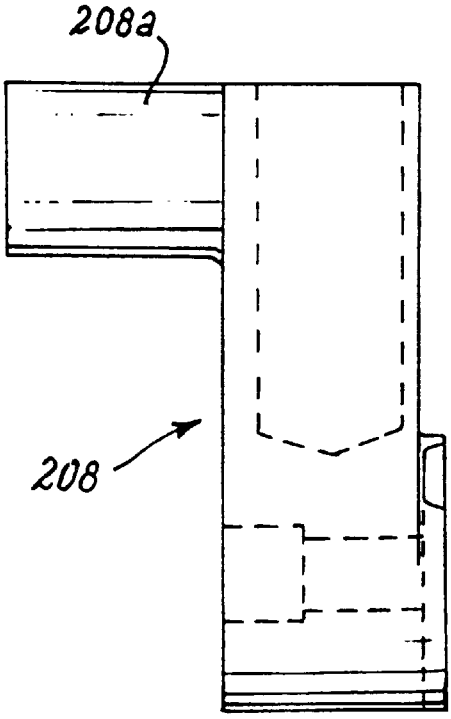
Figure 11:
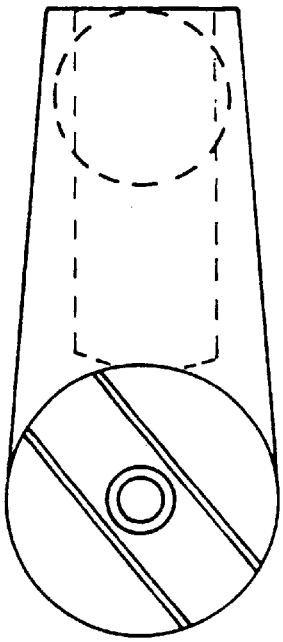
Figure 14:
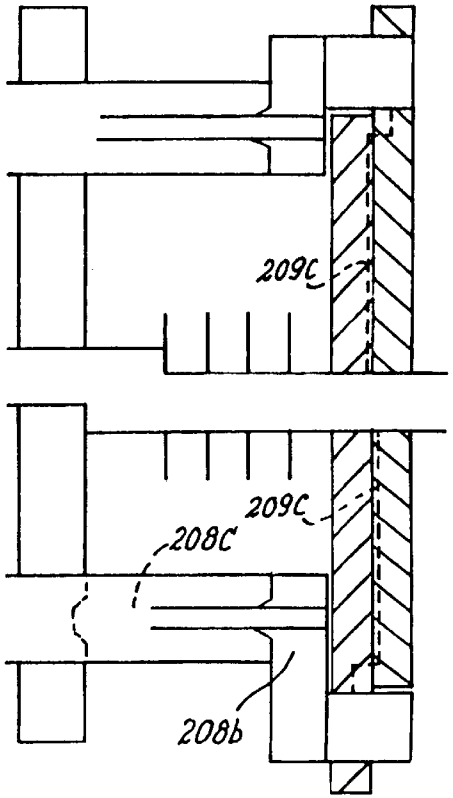
FIGS. 12 to 14 illustrate mounting of spokes.
Figure 13:
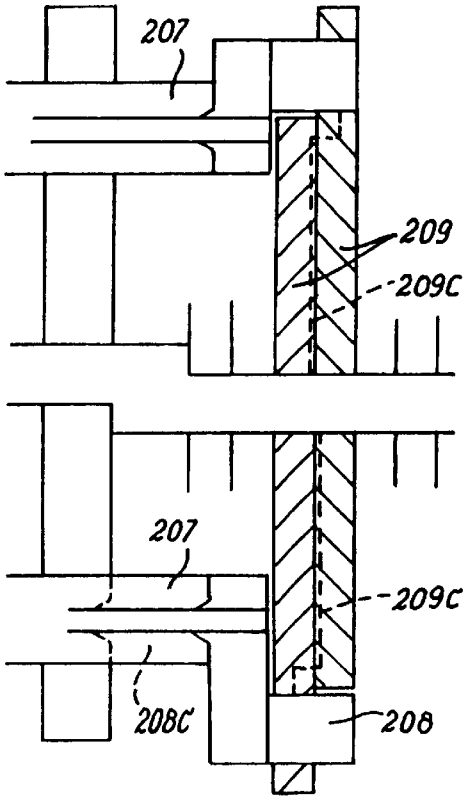
Figure 12:
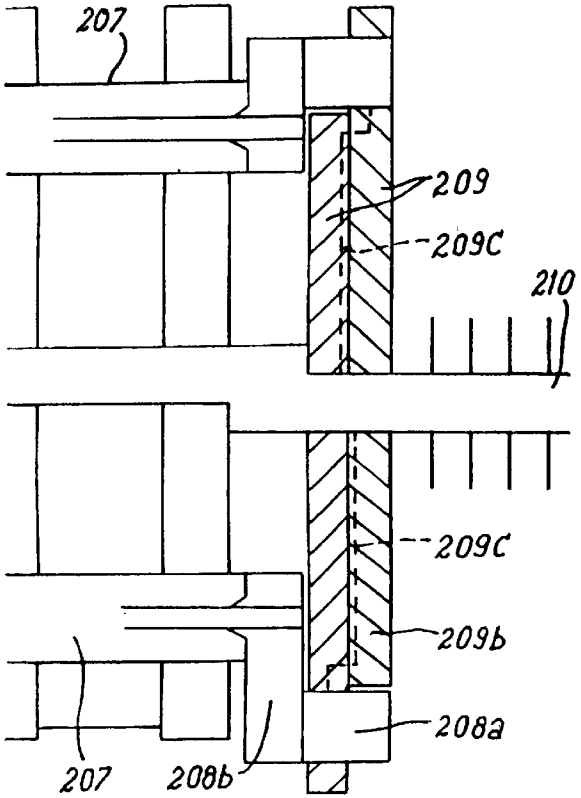
Figure 15:
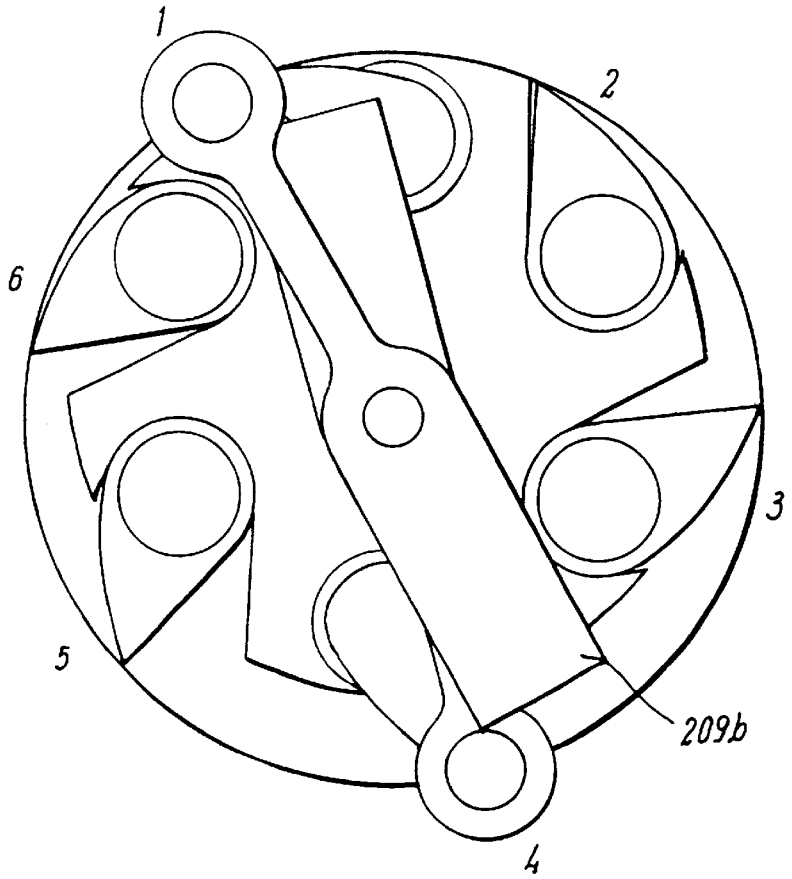
FIG. 15 is an axial schematic of the rotor.

In FIG. 8 the connecting arms or spokes 209 are radial and in pairs (in the case shown three pairs). The crank arms 208 FIGS. 9 to 11 are all the same shape but the vane pivot axles 207 for each pair are of different axial lengths (FIGS. 12 to 14). In this case the cranks in the different pairs move in different paths. Arms 208 include axial portion 208*a* on which the respective connecting arm 209 is pivotable. This reduces the strain on the axially outer crank arms 208*a* compared with an arrangement with parallel spokes 209 and axles 207 of the same axial length which requires crank arms of different shapes. The radial spokes 209 are in substantially parallel planes and each spoke has a radial portion 209*b* FIG. 15 on the opposite side of the centre axis to axle 207 which at least one of which portions is grooved at 209*c* FIG. 12 in a confronting face for entry of lubricating oil from the bearings (not shown) between the spokes 209 and axle 210 and to the bearings (not shown) between the spokes 209 and the crank arms 208.

Figure 17:
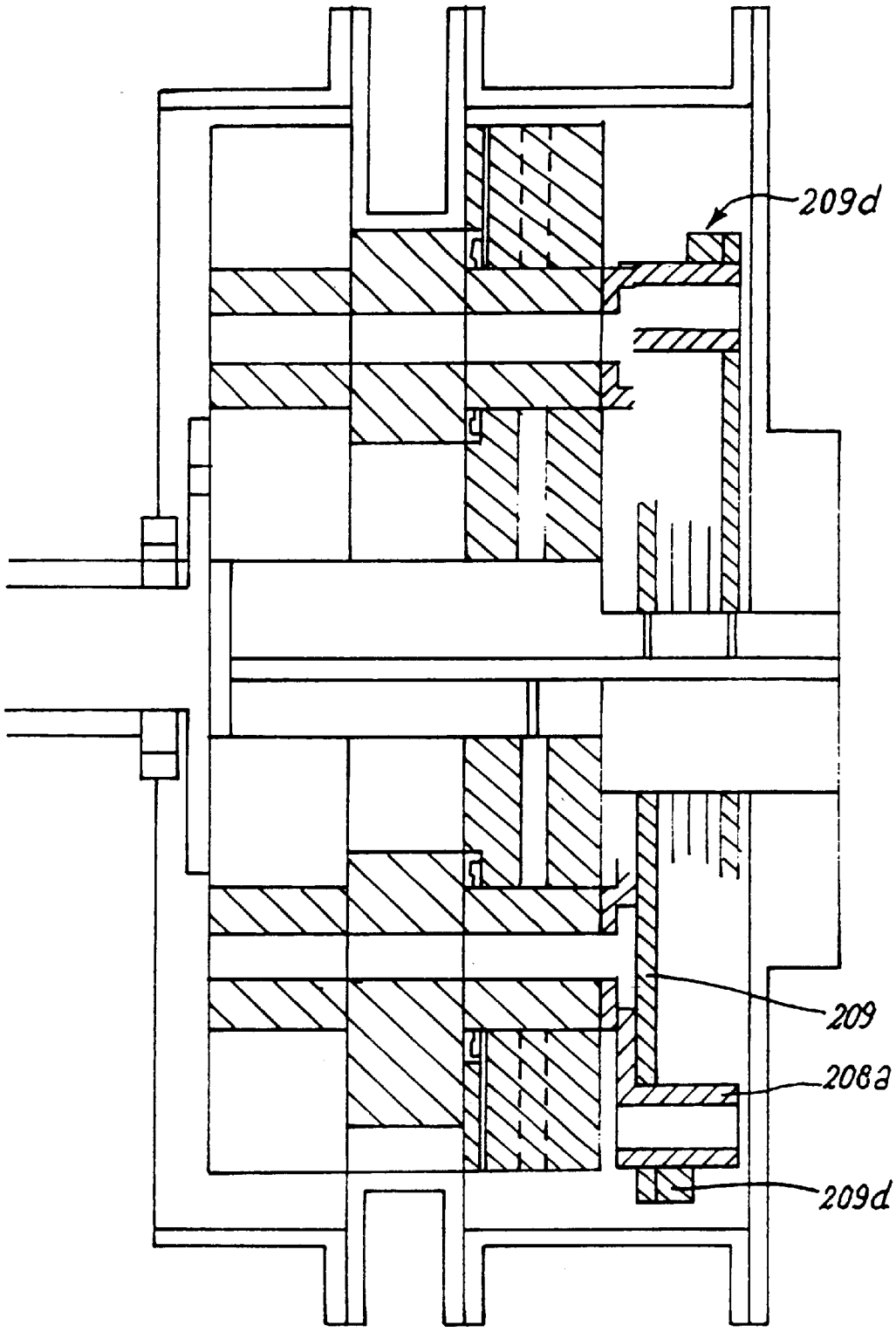
FIG. 17 shows a modification.

In a modification FIG. 17 in which there are for example six spokes 209, the axles 207 are the same shape and the crank arms 208 are all the same shape so that the crank arm portions 208*a* all extend axially the same extent but in this case the width of six spokes; the crank arms as a whole are all the same shape and the axles 207 all have equal axial length. The spokes 209 are at different positions on the arms 208*a*. In this case the crank arms move in a common path. If desired the outer end of each spoke may have an axial and arcuately extending extension 209*d* to provide an added bearing surface on the crank arm 208*a*.

In a further modification, the vane pivot axle components 207 may all have the same length so that the portions 208*b* of the crank arms 208 of the different pairs are of differing lengths as indicated dotted at 208*c*; the crank arms form part of the pivot axles. This applies whether portions 208*a* span two, six or some other number of spokes 209.

Figure 18:
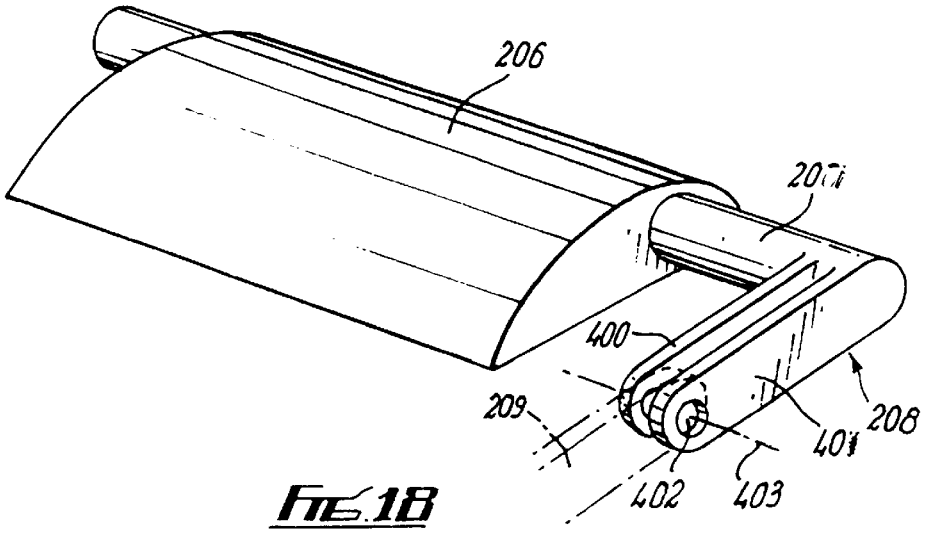
FIG. 18 shows an example.
Figure 18A:
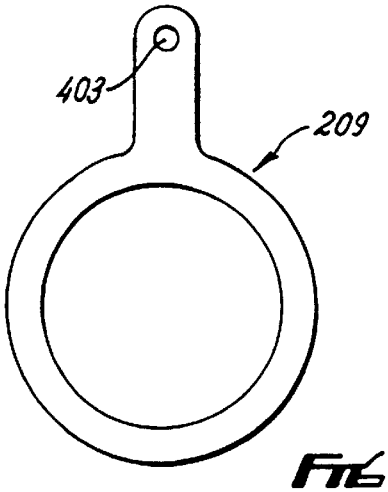
FIG. 18A shows a spoke.

In the present case, see FIG. 18, because the arms 209 at their radially outer ends are radial they can be received between parallel arms 400, 401 integral with the crank arm 208 integral with axle 207. The vane is at 206. The arms 400, 401 replace portion 208*b* and portion 208*a* is omitted. Pivot pin 403 in holes 422 provides a pivot for spoke 209. In this case spoke portion 209*b* is omitted (FIG. 18A). This reduces the stress in the arrangement by substantially reducing twisting torque on arms 400, 401. The arms 209 can be entirely radial (FIG. 17) or radial at their radially inner and outer ends (FIG. 3).

Centre Casing 450

When a circular ring heats up it will expand radially and there will be difficulty in controlling the tip clearance between the ring and a rotor inside the ring.

Figure 16:
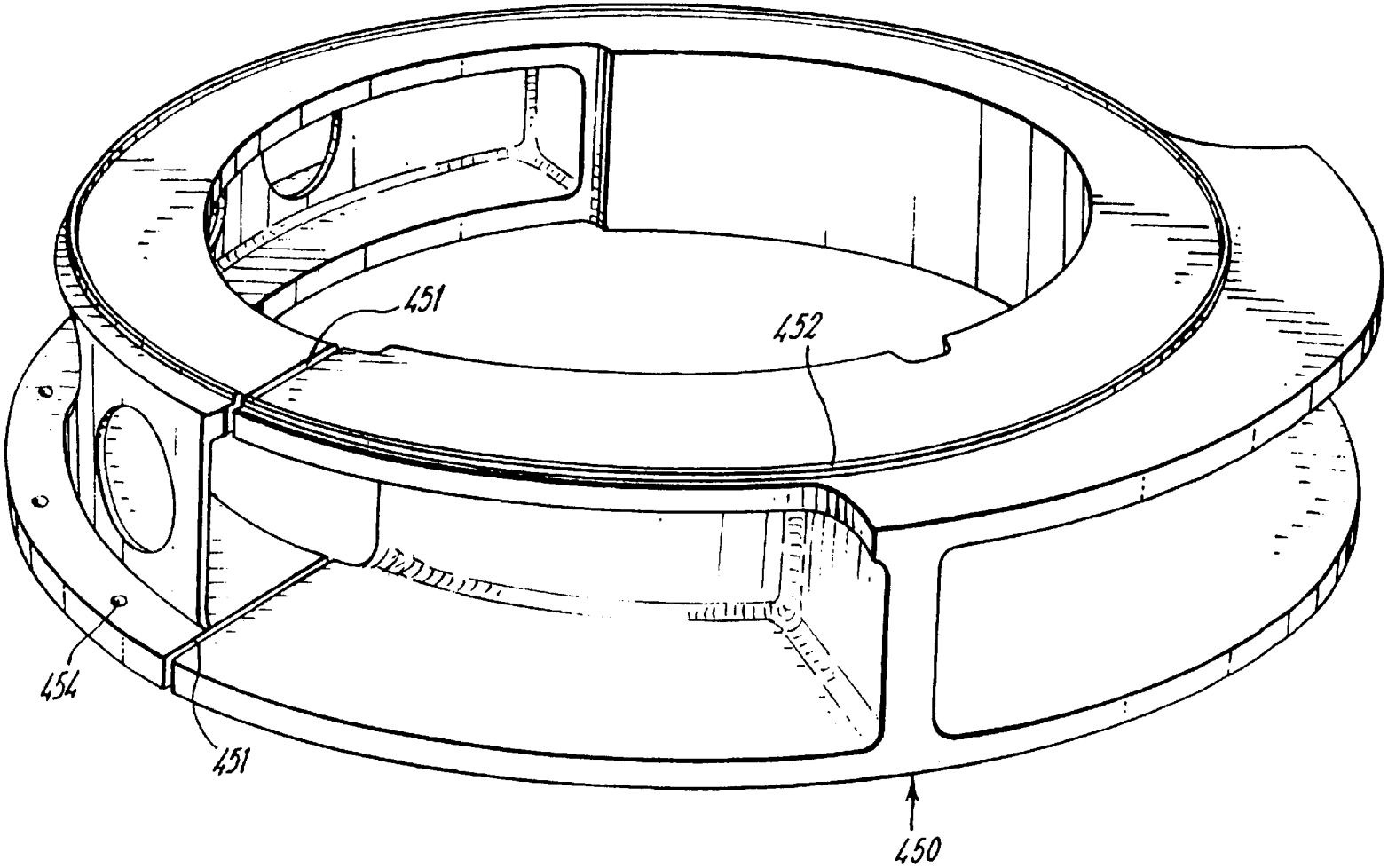
FIG. 16 is a perspective view of a centre casing.

In the present example the ring 450 (casing 202) is cut along one radial line 451 FIG. 16 with a wide cut and another full ring 457, 458 FIG. 8 substantially of constant temperature with respect to the ring 450 is placed on each axial outside and close fitting to the inside ring 450. The inside ring will expand circumferentially and tend to close up the gap 451 but will stay sensibly the same diameter.

In the present example the casing 450 has circumferential axial spigot rings 452 FIGS. 8 and 16 on each side which fit in circumferential axial grooves 453 FIG. 8 in the mating casings 457, 458. Location of the casings is made by bolting 454 all the casings together where the relative temperature is substantially constant with no substantial differential expansion. The spigots resist radial movement. In the case of an air compressor this is over about half the circumference where the air inlet is situated. For the remainder of the circumference, the casings on either side of the split centre casing are connected together by a bridge 456 which spans the centre casting 450.

In the present case, see FIG. 18, because the arms 209 at their radially outer ends are radial they can be received between parallel arms 400, 401 integral with the crank arm 208 Integral with axle 207. The vane is at 206. The arms 400, 401 replace portion 208*b* and portion 208*a* is omitted. Pivot pin 403 in holes 402 provides a pivot for spoke 209. In this case spoke portion 209*b* is omitted (FIG. 18A). This reduces the stress in the arrangement by substantially reducing twisting torque on arms 400, 401. The arms 209 can be entirely radial (FIGS. 12 & 17) in which case the pivot axles are of differing lengths or the arms can be radial at their radially inner and outer ends (FIG. 3) in which case the pivot axles can have the same length. The respective vane, pivot axle and crank can be formed as one piece, reducing manufacturing costs.

Figure 19:
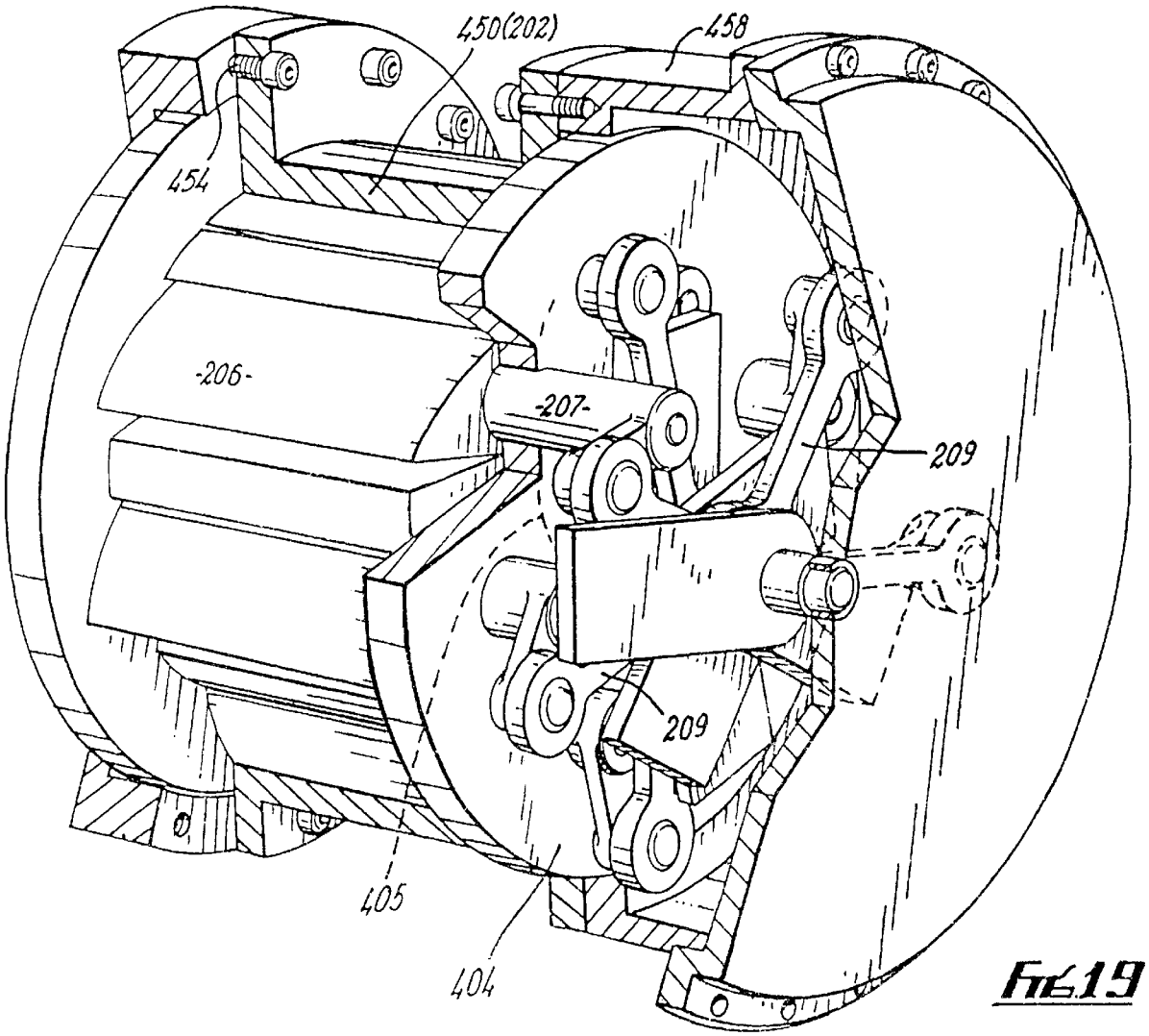
FIG. 19 is a perspective of part of a rotary device.

FIG. 19 shows a perspective view of one arrangement and for assembly purposes the disc 404 (222) can be in two parts divided by an annular split line indicated schematically at 405 so that with suitable manipulation of the axles 207 the radially outer part is fitted first to support the axles and then the radially inner part can be fitted.

Figure 22:
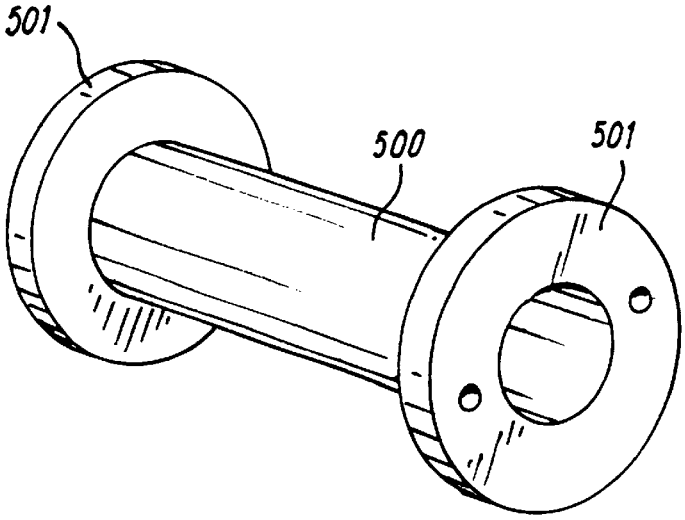
FIG. 22 is a section view of a sleeve.
Figure 23:
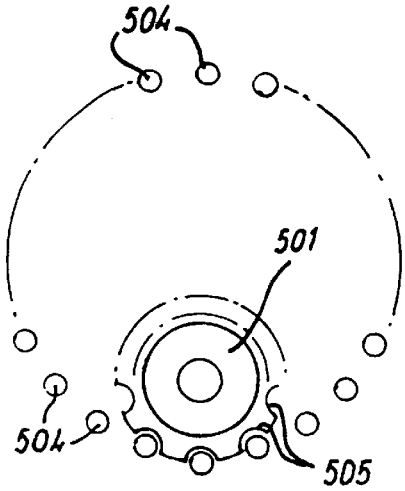
FIGS. 23 and 24 and 25 show forms of coupling.
Figure 24:
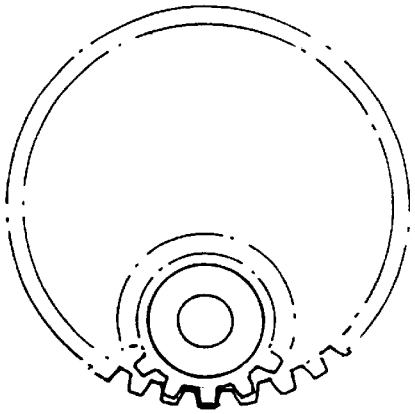
Figures 21, 25, 26:
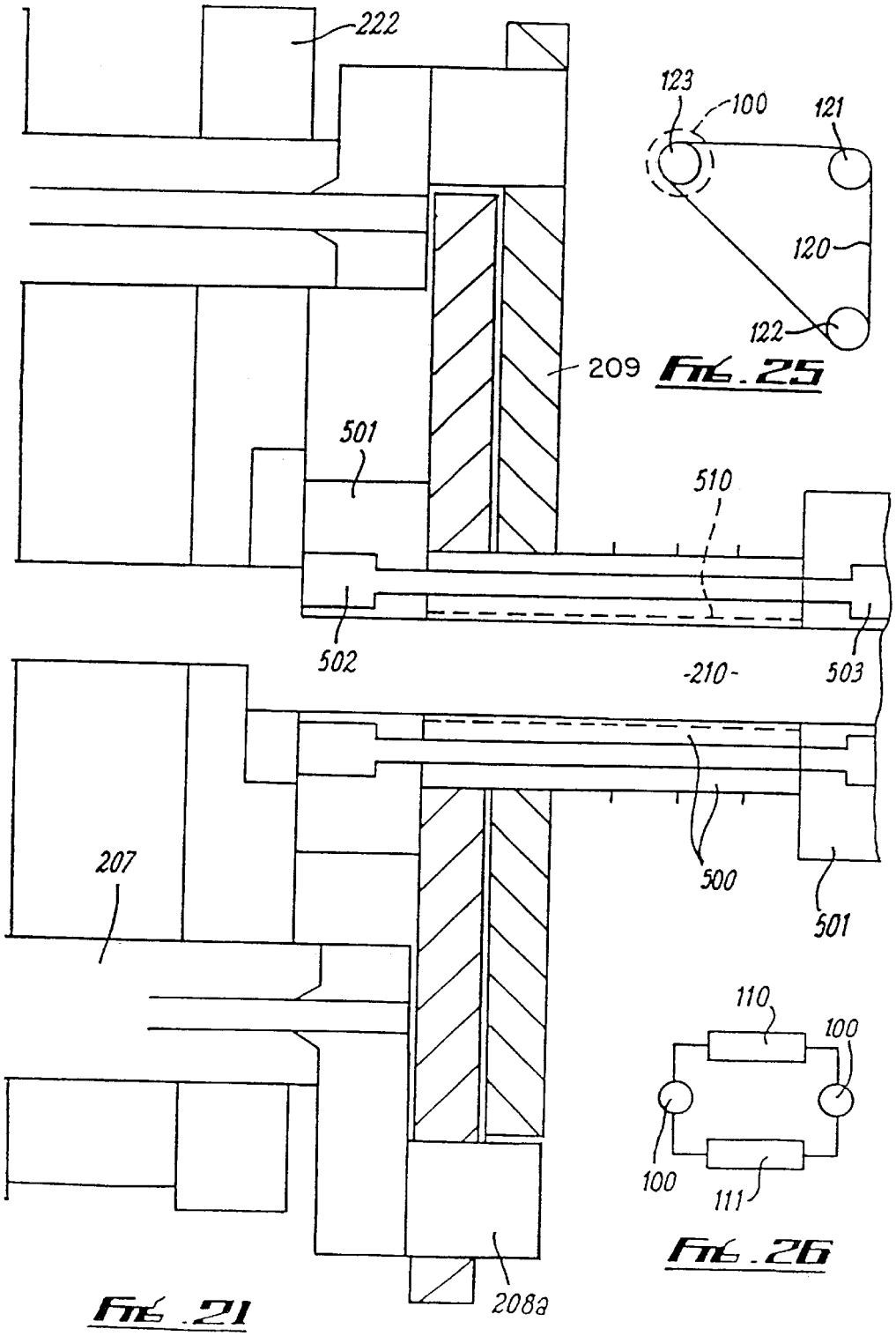
FIG. 21 shows a modification in which a sleeve is fitted on the shaft.
FIG. 26 shows a heat exchanger circuit.

FIGS. 21, 22 show a modification in which a sleeve 500 is fitted on shaft 210. The sleeve 500 revolves around shaft 210 and the spoke connecting arms 209 pivot on the outside diameter of the sleeve. The sleeve 500 has two end plates 501 and the three components are clamped by bolts and nuts 503. The sleeve can be free to rotate by any rubbing contact with mating parts or positively driven by either rotating pegs or meshing gear teeth. Thus engagement with end disc 222 may provide a friction drive; or pegs 504 may extend from disc 222 and engage in scalloped peripheral recesses 505 FIG. 23; or engaging gear teeth 506 may be provided on disc 222 and a plate 501 FIG. 24. The sleeve can be applied to any of the spoke and crank arm designs and enables a simple bearing 510 to be used between the sleeve and the shaft 210.

Figure 20A:
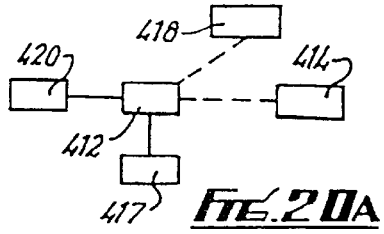
FIG. 20A is a schematic operating system.
Figure 20:
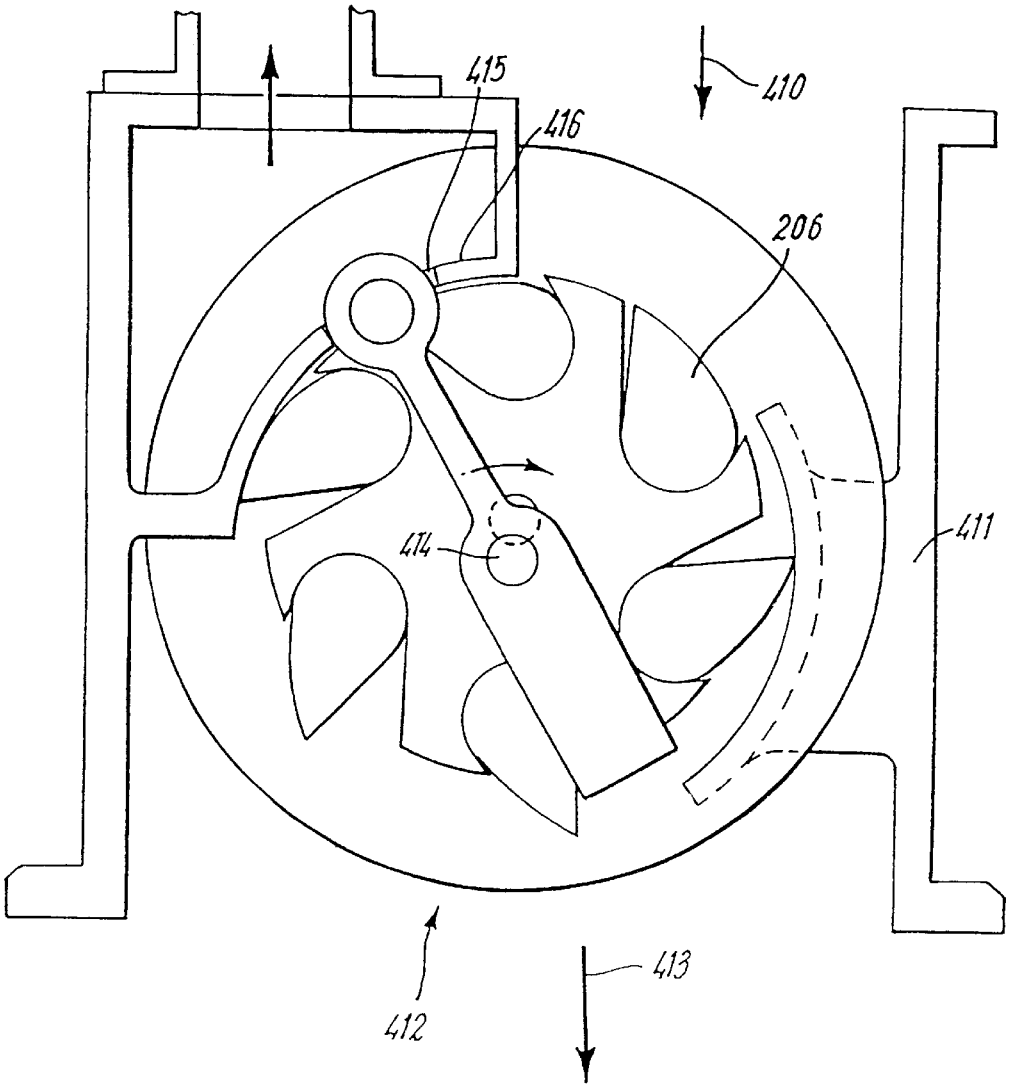
FIG. 20 shows a device in an engine.

A further feature is use of the device of all the above arrangements in combination for a fuel-injected internal combustion engine. In the example shown in FIG. 20 air inlet 410 admits air to casing 411 housing rotary device 412 and air outlet 413 communicates with the engine inlet manifold. When the engine is idling or at low speed, the pressure in the inlet manifold is less than ambient outside casing 411 and the pressure difference rotates the device 412. The device 412 is operatively coupled to the engine crankshaft indicated schematically at 414 thus reducing fuel consumption significantly, perhaps 20% because the energy to create the pressure difference normally is derived from the engine; the described arrangement transmits some of this throttle loss back to the engine.

An outlet 415 may be provided in rotary casing 416 leading to the fuel injection device 417 and at a cold start when the device 412 is rotated initially by the starter motor 420, cold compressed air is delivered at outlet 415 and device 417 to atomise the fuel being injected and thus increasing the chance of ignition thus improving the chance of starting the engine. This feature can be applied also to a sliding vane rotary device.

The device 412 can, if desired, be connected additionally or alternatively to an alternator to charge a battery, which itself may be connected to drive the engine; and the device can be driven by a separate supply of compressed air or the pressure difference between ambient and the inlet manifold.

The device 412 can be used as a compressed-air driven starter motor for an internal combustion engine, to replace an electrically-powered starter motor, by operatively coupling the rotor to the engine crankshaft and driving the motor by compressed air from a supply 418, FIG. 21. FIG. 25 shows a toothed belt 120 coupling pulleys 123, 122, 121 rotatable respectively with a device 100, the crank shaft and the cam shaft of the engine.

The device 100 can be used (FIG. 26) in a circuit with expansion and compression heat exchangers 110, 111, the two devices 100 shown acting respectively as expanders and compressors of refrigerant flowing in the circuit or the expansion and compression could be combined in one unit One of the heat exchangers 110, 111 may take the compressed fluid to act as a heat source. The circuit could be an air conditioning circuit with the device acting as an expander. The rotor may for example rotate at about 3600 revolutions per minute so that much less of the usable energy is absorbed in bringing the fluid up to rotor speed than in a device which rotates at for example 60000 revolutions.

The internal combustion engine can be static or in a vehicle.

What is claimed is:

1. An internal combustion engine in combination with a rotary positive displacement fluid machine having a rotor eccentrically mounted in a casing with a plurality of vanes defining compartments within the casing which vary in volume as the rotor rotates, the machine being connected to an air inlet manifold of the engine, and to atmoshere, such that the rotor is driven by the pressure difference between ambient air and air at the inlet manifold, the machine being operatively connected to an energy using device.

2. An engine as claimed in claim 1, characterised in that the energy-using device is a crank-shaft of the engine.

3. An engine as claimed in claim 1, characterised in that the energy-using device is an alternator for charging a battery.

4. An engine as claimed in claim 1, in which the rotary device is connected to deliver compressed air to a fuel-injection device for the engine.

5. An engine as claimed in claim 1, characterised by a source of compressed air independent of the engine connected for driving the rotary device.

6. An internal combustion engine according to claim 1, wherein the device includes a rotor eccentrically mounted in a casing, the rotor having a plurality of vanes, each vane being connected to an oscillating arm via a crank and having a pivot axle, the crank having elements pivotally embracing a radial outer end of the oscillating arm.

7. An engine according to claim 6, which the oscillating arms are in radial planes.

8. An engine according to claim 6, which the oscillating arms are radial at their inner and outer ends.

9. An engine according to claim 1, in which the device has a rotor eccentrically mounted in a casing, the rotor having a plurality of vanes, each vane being connected to an oscillating arm via a crank and having a pivot axle, the oscillating arms being in planes radial to the rotor axis.

10. An engine according to claim 6, in which the oscillating arms are in pairs with confronting faces and have groove means in one or both of the confronting faces for access of lubricating oil.

11. An engine according to claim 6, in which the cranks have the same shape.

12. An engine according to claim 6, in which the pivot axles have the same length.

13. An engine according to claim 6, in which at least some of the pivot axles have different lengths.

14. An engine according to claim 6, in which the oscillating arms are rotatable on a sleeve rotatable on a support pillar.

15. An engine according to claim 6, in which the respective vane, pivot axle and crank are in one piece.

16. An engine according to claim 15, in which the rotor comprises an end disc supporting the pivot axles, the end disc having radially inner and outer parts which are separable for assembly and disassembly.

17. An engine according to claim 1, in which the device has a rotor eccentrically mounted in a casing with vanes defining compartments within the casing in which the rotor has axially outer parts and an axially intermediate part, the intermediate part being split to permit circumferential expansion and the outer parts being connected to the intermediate part by means which resist radial movement.

18. An engine according to claim in 17, which the means which resist radial movement comprise interengaging formations on the outer parts of the intermediate parts.

19. An engine according to claim 17, in which the interengaging formations comprise grooves on the outer parts and annular rings on the intermediate part or annular rings on the outer parts and grooves on the intermediate part.

* * * * *